US011779789B2

(12) United States Patent
Jones

(10) Patent No.: US 11,779,789 B2
(45) Date of Patent: Oct. 10, 2023

(54) PLYOMETRIC BOX

(71) Applicant: Coulter Ventures, LLC., Columbus, OH (US)

(72) Inventor: Dylan Jones, Santa Barbara, CA (US)

(73) Assignee: Coulter Ventures, LLC., Columbus, OH (US)

( * ) Notice: Subject to any disclaimer, the term of this patent is extended or adjusted under 35 U.S.C. 154(b) by 21 days.

(21) Appl. No.: 17/152,267

(22) Filed: Jan. 19, 2021

(65) Prior Publication Data

US 2021/0138289 A1 May 13, 2021

Related U.S. Application Data

(63) Continuation-in-part of application No. 29/743,211, filed on Jul. 20, 2020, now Pat. No. Des. 944,903, which is a continuation of application No. 29/680,387, filed on Feb. 15, 2019, now Pat. No. Des. 890,869.

(60) Provisional application No. 62/961,990, filed on Jan. 16, 2020.

(51) Int. Cl.

| | |
|---|---|
| ***A63B 21/00*** | (2006.01) |
| ***A63B 23/035*** | (2006.01) |
| ***A63B 23/04*** | (2006.01) |

(52) U.S. Cl.

CPC .... *A63B 21/00047* (2013.01); *A63B 21/4033* (2015.10); *A63B 23/03525* (2013.01); *A63B 23/0405* (2013.01)

(58) Field of Classification Search

CPC .... A63B 5/00; A63B 5/12; A63B 5/01; A63B 21/00047; A63B 21/0005; A63B 21/00054; A63B 21/00178; A63B 23/0458; A47C 9/002; A47C 3/04; A47C 12/00; A47B 7/02

See application file for complete search history.

(56) References Cited

U.S. PATENT DOCUMENTS

| | | | | |
|---|---|---|---|---|
| 1,095,945 A | | 5/1914 | Tellander | |
| D123,472 S | | 11/1940 | Caldwell, Jr. | |
| D157,319 S | * | 2/1950 | Bair | 248/163.1 |
| D271,256 S | * | 11/1983 | McClelland | D6/349 |

(Continued)

FOREIGN PATENT DOCUMENTS

DE 19507093 C1 10/1996

OTHER PUBLICATIONS

Product listing for Rogue Wood Plyo Boxes, from https://web.archive.org/web/20170708230654/https://www.roguefitness.com/rogue-wood-plyoboxes, dated Jul. 8, 2017.

(Continued)

*Primary Examiner* — Sundhara M Ganesan
*Assistant Examiner* — Zachary T Moore
(74) *Attorney, Agent, or Firm* — Banner & Witcoff, Ltd.

(57) ABSTRACT

A plyometric box for includes a platform, a first pair of opposed sidewalls, and a second pair of opposed sidewalls. Each sidewall extends downwardly from the platform, and includes a first side, an opposed second side, a first pair of stacking ribs on an interior surface of the sidewall proximate the first side, and a second pair of stacking ribs on an interior surface of the sidewall proximate the second side. Each stacking rib extends downwardly from the platform along the sidewall and a bottom surface of each stacking rib is spaced upwardly from a bottom edge of the sidewall.

23 Claims, 7 Drawing Sheets

(56) References Cited

U.S. PATENT DOCUMENTS 4,630,861 A 12/1986 Henschel
4,950,033 A 8/1990 Anderson
5,176,596 A 1/1993 Ullman
D335,966 S 6/1993 Schwartzkopf et al.
D337,211 S * 7/1993 Bergkvist ..... D6/349
5,226,865 A 7/1993 Chin
D339,179 S 9/1993 Wilkinson
D343,960 S 2/1994 Leduc
5,290,210 A 3/1994 Hand et al.
D346,630 S 5/1994 Van Der Hoeven
D346,704 S 5/1994 Grosfillex
D347,666 S 6/1994 Hand
D349,540 S 8/1994 Hand et al.
5,354,247 A * 10/1994 Wilkinson ..... A63B 23/0458 206/505
D355,988 S 3/1995 Brooking
D360,767 S 8/1995 Fish et al.
D370,949 S 6/1996 Furner
5,749,555 A * 5/1998 Albrecht ..... A47C 9/025 482/52
5,855,536 A 1/1999 Wilkinson
D408,555 S 4/1999 Albrecht
D449,357 S 10/2001 Monter Villar et al.
D449,662 S 10/2001 Monter Villar et al.
D460,566 S 7/2002 Henschel et al.
6,886,660 B2 5/2005 Sapatova
D553,370 S 10/2007 Meyers et al.
D557,910 S 12/2007 Saunders et al.
D558,473 S 1/2008 Mendenhall
D566,856 S 4/2008 Eveleth
D566,977 S 4/2008 Emge
D571,486 S * 6/2008 Miller ..... D25/133
D571,608 S 6/2008 Yeung
D579,680 S 11/2008 Emert
D581,726 S 12/2008 Shamoon
D582,168 S 12/2008 Sandel
D586,923 S 2/2009 Eveleth
D589,630 S 3/2009 Henson et al.
D590,123 S * 4/2009 Hermans ..... D34/38
7,591,763 B1 9/2009 Fucci
D609,927 S 2/2010 Floer
D615,667 S 5/2010 Dunn et al.
D632,101 S 2/2011 Sandel et al.
D639,080 S 6/2011 van der Lande
D650,184 S 12/2011 Hsu
D667,681 S 9/2012 Carsten
D668,070 S 10/2012 Kim
8,414,414 B2 * 4/2013 Viramontez ..... A63B 26/003 473/270
D681,750 S 5/2013 Meyer-Hayoz
D682,634 S 5/2013 Datavs
D690,522 S 10/2013 Pontiff
D707,975 S 7/2014 Habraken
D710,031 S 7/2014 Simpson et al.
D727,044 S 4/2015 Tu
8,998,741 B2 4/2015 Viramontez
D736,867 S * 8/2015 Glickfield ..... D21/671
D736,869 S 8/2015 Harker
D737,909 S 9/2015 Kubitz
D751,309 S 3/2016 Habraken
D774,349 S 12/2016 Zemel et al.
D779,860 S 2/2017 Siao
D811,784 S 3/2018 Sartain
D813,961 S * 3/2018 Ness ..... D21/686
D815,847 S 4/2018 Vincent
D828,049 S 9/2018 Khubani
D831,134 S 10/2018 Hillson
10,271,655 B1 4/2019 Gwen
D859,017 S 9/2019 Baker
D890,869 S 7/2020 Jones
D902,652 S 11/2020 Seymour
D902,653 S 11/2020 Seymour
D903,416 S 12/2020 Seymour
10,926,122 B2 * 2/2021 Hausheer ..... A63B 5/16
2004/0142802 A1 7/2004 Greenspan et al.
2006/0287171 A1 12/2006 Gerstung
2008/0093167 A1 * 4/2008 Saunders ..... A47C 12/00 182/222
2008/0318743 A1 12/2008 Bizzell et al.
2010/0207004 A1 * 8/2010 Hermans ..... F24H 9/06 248/346.01
2013/0023392 A1 * 1/2013 Glickfield ..... A63B 17/04 482/142
2014/0087930 A1 3/2014 Burns et al.
2014/0131138 A1 * 5/2014 Simpson ..... A47C 12/00 182/223
2015/0083522 A1 3/2015 Chancler
2017/0080284 A1 * 3/2017 Hillson ..... A63B 21/4033
2017/0215594 A1 * 8/2017 Baker ..... A47C 12/00
2017/0361167 A1 * 12/2017 Rogowski ..... A63B 21/00069
2018/0071575 A1 3/2018 Crass
2020/0246657 A1 * 8/2020 Wittenbrink ..... A63B 21/4033
2021/0169228 A1 * 6/2021 Yang ..... A47C 12/00

OTHER PUBLICATIONS

Product listing for Rogue Games Box, from https://web.archive.org/web/20170625162158/http://www.roguefitness.com/rogue-games-box, dated Jun. 25, 2017.
Product listing for Rogue Foam Games Box, from https://web.archive.org/web/20170708224917/https://www.roguefitness.com/rogue-foam-games-box, dated Jul. 8, 2017.
Product listing for Rogue Flat Pack Games Box, from https://web.archive.org/web/20170602020329/http://www.roguefitness.com/rogue-flat-pack-games-box, dated Jun. 2, 2017.
Product listing for Rogue Steel Plyo Boxes, from https://web.archive.org/web/20170612212715/http://www.roguefitness.com/steel-plyoboxes, dated Jun. 12, 2017.
Product listing for Rogue Foam Plyo Boxes, from https://web.archive.org/web/20170701065301/http://www.roguefitness.com:80/rogue-foam-plyoboxes, dated Jul. 1, 2017.
Apr. 29, 2021 (WO) International Search Report & Written Opinion PCT/US2021/013978.
Anonymous: "Rogue Resin Plyo Box", Jan. 1, 2018 (Jan. 1, 20181), XP055771031, Retrieved from the Internet: URL: www.roguefitness.com/rogue-resin-plyobox?bvstate=pg:3/ct:r (retrieved on Feb. 2, 2021).
Resin by Rogue dated Dec. 10, 2018. Found online [Dec. 10, 2020 https://www.roguefitness.com/rogue-resin-plyobox?bvstate=pg:3/ct:r (Year: 2018).

* cited by examiner

PLYOMETRIC BOX

CROSS-REFERENCE TO RELATED APPLICATIONS

This application claims priority to and the benefit of U.S. Patent Application No. 62/961,990, filed on Jan. 16, 2020; and is a Continuation-in-Part of U.S. Design application Ser. No. 29/743,211, filed on Jul. 20, 2020, which is a continuation of U.S. Design application Ser. No. 29/680,387, filed on Feb. 15, 2019, now U.S. Pat. No. D890,869; each of which is incorporated herein by reference in its entirety.

TECHNICAL FIELD

Aspects of this disclosure relate generally to a plyometric box, and more particularly, to a plyometric box with features that enhance the stackability of a plurality of plyometric boxes.

BACKGROUND

Plyometric boxes, or jumping boxes, are often used by individuals for power training exercises, allowing the user to jump up onto and off of the box. By jumping up onto and off of such a box, an individual can exert their muscles to high potential in a short period of time. Gyms and other exercise facilities may have a plurality of plyometric boxes, allowing multiple individuals to use the stools either individually, or in a class. Additionally, a facility may utilize a plurality of plyometric boxes having different heights. For storage, the plyometric boxes may be stacked together in order to reduce the space and/or square footage required to store the stools. A problem may arise when stacking plyometric boxes, as they may become wedged together and hard to separate.

BRIEF SUMMARY

Aspects of the disclosure relate to a plyometric box that includes a platform, a first pair of opposed sidewalls, and a second pair of opposed sidewalls. Each sidewall extends downwardly from the platform, and includes a first side, an opposed second side, a first stacking rib or pair of stacking ribs on an interior surface of the sidewall proximate the first side, and a second stacking rib or pair of stacking ribs on the interior surface of the sidewall proximate the second side. Each stacking rib extends downwardly from the platform along the sidewall, and a bottom surface of each stacking rib is spaced upwardly from a bottom edge of the sidewall.

Additional aspects of the disclosure relate to a plyometric box that includes a platform, a first pair of opposed sidewalls, and a second pair of opposed sidewalls. Each sidewall extends downwardly from the platform, and includes a first side, an opposed second side, a first stacking rib or pair of stacking ribs on an interior surface of the sidewall proximate the first side, and a second stacking rib or pair of stacking ribs on the interior surface of the sidewall proximate the second side. Each of a plurality of vertical wall support ribs extends along one of the sidewalls. A bottom surface of each stacking rib is spaced upwardly from a bottom edge of one of the sidewalls. Each stacking rib extends outwardly from one of the vertical wall support ribs into an interior of the plyometric box. An intersection of a top surface of the platform and an exterior surface of each sidewall is rounded over with a first radius. An intersection of the bottom surface of each of the stacking ribs and an interior edge of one of the wall support ribs includes a fillet having a second radius that is substantially the same as the first radius.

Further aspects of the disclosure relate to a plyometric box that includes a platform, a first pair of opposed sidewalls, and a second pair of opposed sidewalls, each sidewall extending downwardly from the platform and including a first side and an opposed second side. Each sidewall includes a curved arm formed along the first side of the sidewall and defining a corner of the plyometric box, a shoulder formed at the second side of the sidewall, and a lip extending laterally outwardly from the second side of the sidewall, such that the lip is recessed from an exterior surface of the sidewall, and the shoulder extends from the exterior surface to the lip. An end of the curved arm of each sidewall is nested against one of the shoulders and an exterior surface of the lip of an adjacent sidewall.

Other features and advantages of the disclosure will be apparent from the following description taken in conjunction with the attached drawings.

BRIEF DESCRIPTION OF DRAWINGS

To allow for a more full understanding of the present disclosure, it will now be described by way of example, with reference to the accompanying drawings in which.

DETAILED DESCRIPTION

Figure 1:
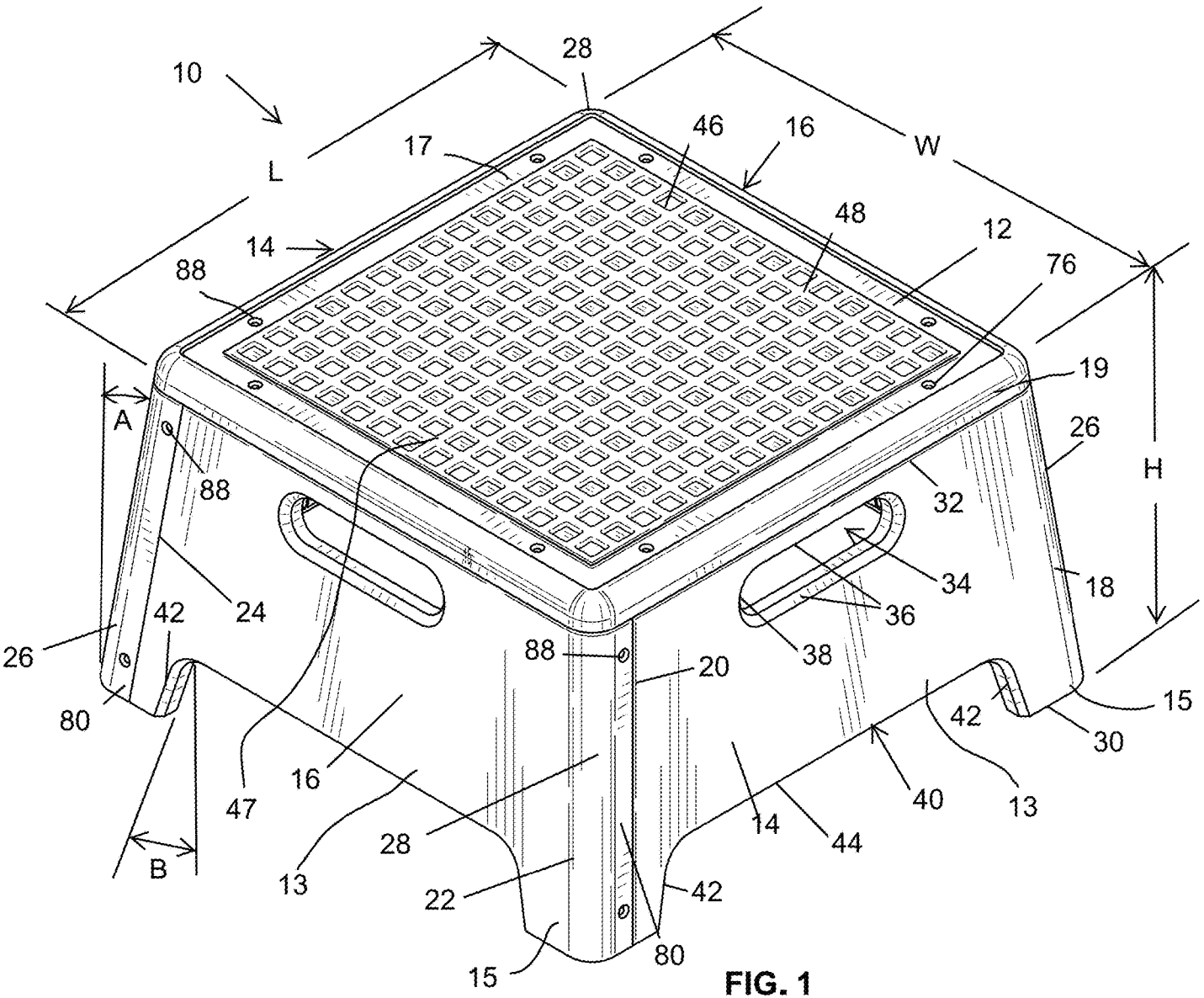
FIG. 1 is a perspective view of one embodiment of a plyometric box according to aspects of the disclosure.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

FIGS. 1-5 illustrate one example embodiment of a jump box or plyometric box 10, according to aspects of the disclosure. Plyometric box 10 may include a generally horizontal platform 12 that a user may jump up onto and off of repeatedly when doing aerobic exercises. Plyometric box 10 may include a first pair of opposed sidewalls 14 and a second pair of opposed sidewalls 16 extending downwardly from platform 12. First sidewalls 14 may include a first or right side 18 and an opposed second or left side 20. Second sidewalls 16 may include a first or right side 22 and an opposed second or left side 24. The right side 18 of each first sidewall 14 may be connected to the left side 24 of an adjacent second sidewall 16 to define a pair of first corners 26 of plyometric box 10. Similarly, the left side 20 of each first sidewall 14 may be connected to the right side 22 of an adjacent second sidewall 16 to define a pair of second corners 28. The plyometric box 10 further includes feet 15 or other supporting structures located at the bottom of the sidewalls 14, 16 that are configured to rest on a supporting surface to support the box 10. The feet 15 in FIGS. 1-5 have an L-shape or other angular shape, and each foot 15 is positioned at, and extends around, one of the corners 26, 28. In this embodiment, each foot 15 is defined by portions of two adjacent sidewalls 14, 16 that juncture at or proximate the corner 26, 28 on which the foot 15 is positioned.

In certain embodiments, some or all components of the plyometric box 10 may be formed of a plastic or other polymer material, such as a resin, for example. In one embodiment, the platform 12 and all four sidewalls 14, 16, and subcomponents of the same, may be formed of such materials. It is to be appreciated that plyometric box 10 may be formed of recycled materials in certain embodiments. In certain embodiments, elements or components of plyometric box 10 may be compression molded.

In certain embodiments, as illustrated in FIG. 1, sidewalls 14 and 16 may be angled inwardly and upwardly from a bottom edge 30 thereof to a top edge 32 thereof at an angle A with respect to a vertical direction. It is to be appreciated that sidewalls 14 and 16 could also be considered to be angled downwardly and outwardly from top edge 32 to bottom edge 30. In certain embodiments, angle A may be between approximately 2° and approximately 10°, and more particularly, approximately 6°. It is understood that the sidewalls 14, 16 may also be angled with respect to the general plane of the platform 12, which angle may be expressed as (90°+A).

The term "approximately" as used herein is meant to mean close to, or about a particular value, within the constraints of sensible commercial engineering objectives, costs, manufacturing tolerances, and capabilities in the field of plyometric box manufacturing and use. Similarly, the term "substantially" as used herein is meant to mean mostly, or almost the same as, within the constraints of sensible commercial engineering objectives, costs, manufacturing tolerances, and capabilities in the field of plyometric box manufacturing and use.

In certain embodiments, specifications including dimensions listed herein may vary by +/−5% or +/−10% of the nominal values identified. In other embodiments, the dimensional specifications may vary by +/−0.05 inch or +/−0.03 inch.

In certain embodiments, each of sidewalls 14 and 16 may be identical to one another, and each may include a slot or aperture 34 extending therethrough proximate top edge 32. Apertures 34 may be elongated in form, with rounded ends. In one embodiment (e.g., FIG. 1), apertures 34 may be racetrack shaped, with opposed longitudinal sides 36 joined by hemispherical shaped ends 38. Apertures 34 may serve as handles, allowing the user to easily grasp and pick up plyometric box 10. It is to be appreciated that apertures 34 could have other shapes, such as oval or rectangular, for example, and that other suitable shapes for apertures 34 will become readily apparent to those skilled in the art, given the benefit of this disclosure.

Figure 6:
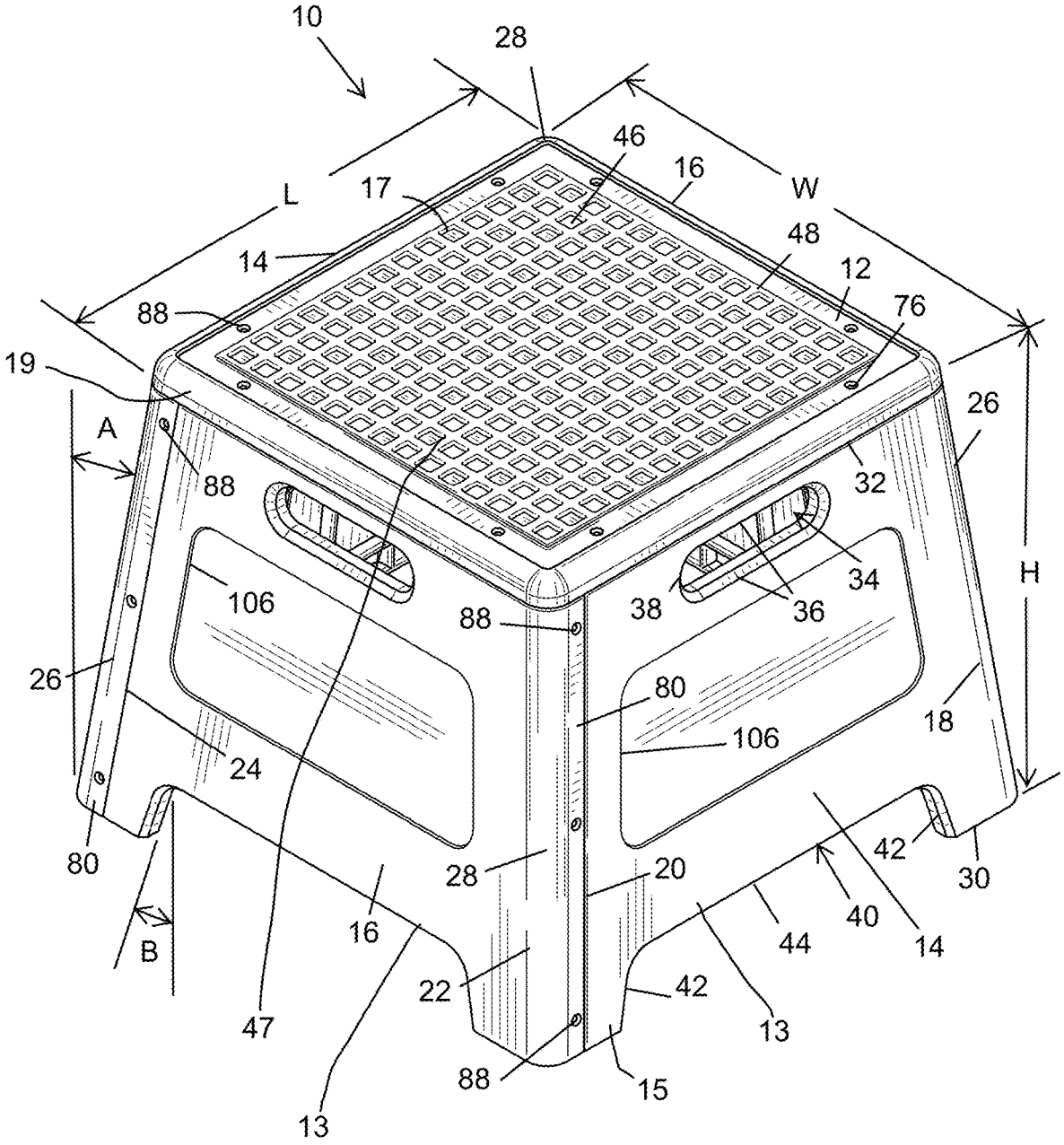
FIG. 6 is a perspective view of another embodiment of a plyometric box according to aspects of the disclosure.

Plyometric box 10 may have a height H, a width W, and a length L. In certain embodiments, height H may be approximately 12 inches. As discussed in greater detail below, a plurality of plyometric boxes 10 may be provided, with one or more additional plyometric boxes having a different height H, allowing users to jump to different heights, thereby varying their workout routine. In certain embodiments, width W may be approximately 19 inches, and length L may be approximately 19 inches. The width W and length L shown in FIG. 6 are measured at the top of the box 10 (i.e., at the platform 12), and it is understood that the width and length of the box 10 may be greater at the base due to the outward angle of the sidewalls 14, 16. Although width W and length L can be different than one another, it may be advantageous to have sidewalls 14 and 16 formed as identical members and maintain width W and length L at the same dimension. Further, a set or kit of plyometric boxes 10 may be provided that all have different heights H, but the same width W and length L (e.g., approximately 19 inches in one embodiment).

Each sidewall 14, 16 may include a wall notch 40 formed along bottom edge 30, with wall notch 40 including a pair of opposed notch sidewalls 42 and an upper surface 44. In certain embodiments, notch sidewalls 42 may be angled upwardly and inwardly from bottom edge 30 of sidewalls 14, 16 to upper surface 44 at an angle B. In certain embodiments, angle B may be between approximately 10° and approximately 20°, and more particularly, approximately 15°. The wall notches 40 may be located between the feet 15 and may define the edges of the feet 15.

In certain embodiments, a plurality of recesses 46 may be formed in the top surface 48 of platform 12. In certain embodiments, recesses 46 may be rectangular, or square, and may be arranged in a grid or array on top surface 48. The recesses 46 may be separated by ribs 47 that are also arranged into a grid pattern. Recesses 46 and ribs 47 may serve to provide traction to users when jumping onto and off of platform 12 of plyometric box 10.

Figure 2:
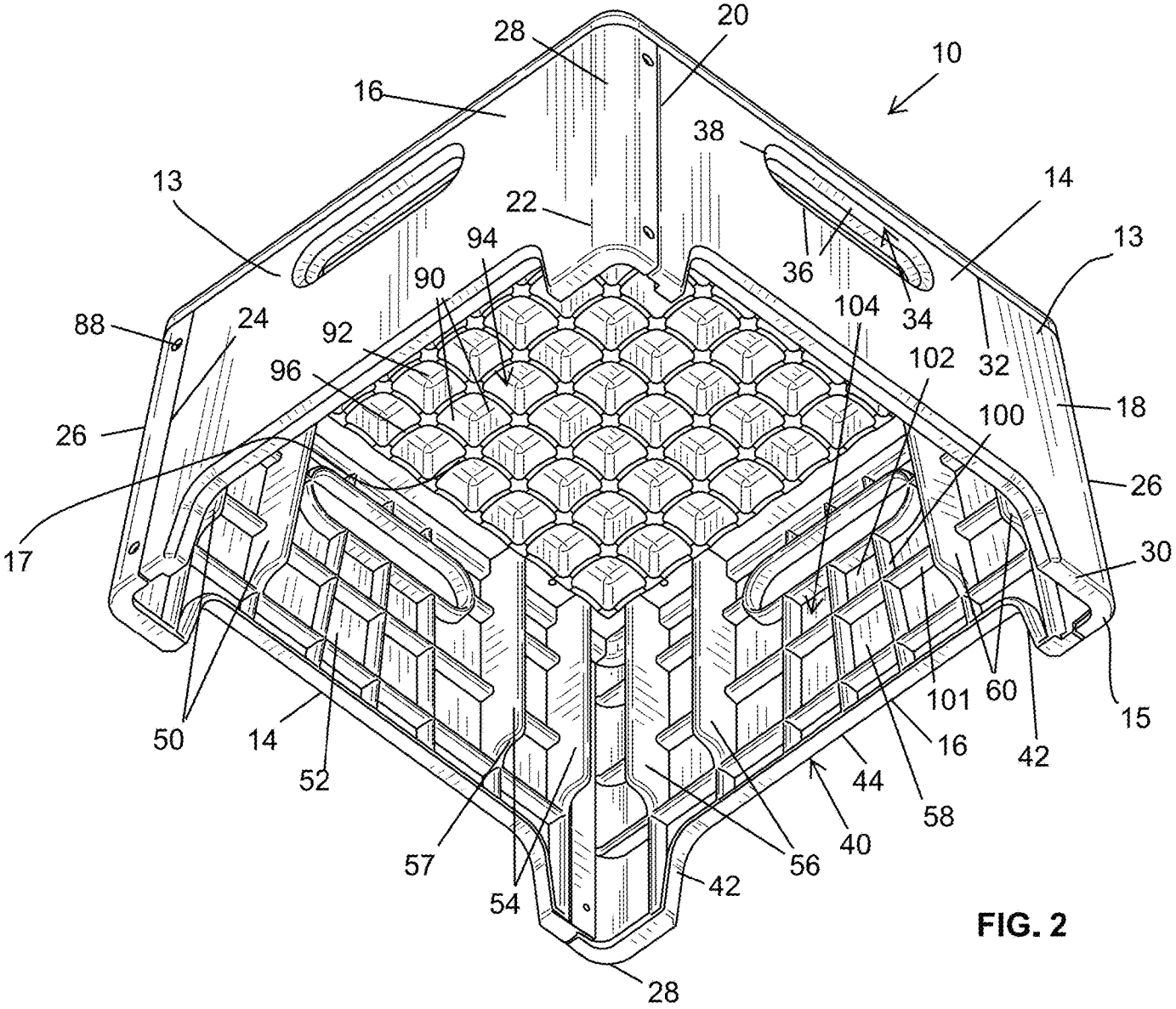
FIG. 2 is a bottom perspective view of the plyometric box of FIG. 1.

Each sidewall 14, 16 may include one or more stacking ribs 50, 54, 56, 60 on the interior surface 52 thereof in one embodiment, and each sidewall 14, 16 may include a plurality of stacking ribs 50, 54, 56, 60. Such stacking ribs 50, 54, 56, 60 may extend outwardly from and vertically along the interior surface 52 of the sidewall 14, 16. As illustrated in FIG. 2, a first pair of stacking ribs 50 may be formed on and extend outwardly from and vertically along an interior surface 52 of first sidewall 14 toward an interior of plyometric box 10. Stacking ribs 50 may be positioned proximate first side 18, between first side 18 and aperture 34, may extend vertically along an entire height of first sidewall 14, substantially parallel to one another, and further extend outwardly from first sidewall 14 toward the interior of plyometric box 10. A second pair of stacking ribs 54 may be formed on and extend vertically along interior surface 52 of first sidewall 14, substantially parallel to one another, and may further extend outwardly toward the interior of plyometric box 10. Stacking ribs 54 may be positioned proximate second side 20, between second side 20 and aperture 34, and may extend along an entire height of first sidewall 14, substantially parallel to one another.

Similarly, a first pair of stacking ribs 56 may be formed on and extend vertically along an interior surface 58 of second sidewall 16, and may further extend outwardly toward the interior of plyometric box 10. Stacking ribs 56 may be positioned proximate first side 22, between first side 22 and aperture 34, and may extend along an entire height of second sidewall 16, substantially parallel to one another. A second pair of stacking ribs 60 may be formed on and extend vertically along interior surface 58 of second sidewall 16, and may further extend outwardly toward the interior of plyometric box 10. Stacking ribs 56 may be positioned proximate second side 24, between second side 24 and aperture 34, and may extend along an entire height of second sidewall 16, substantially parallel to one another.

Figure 4:
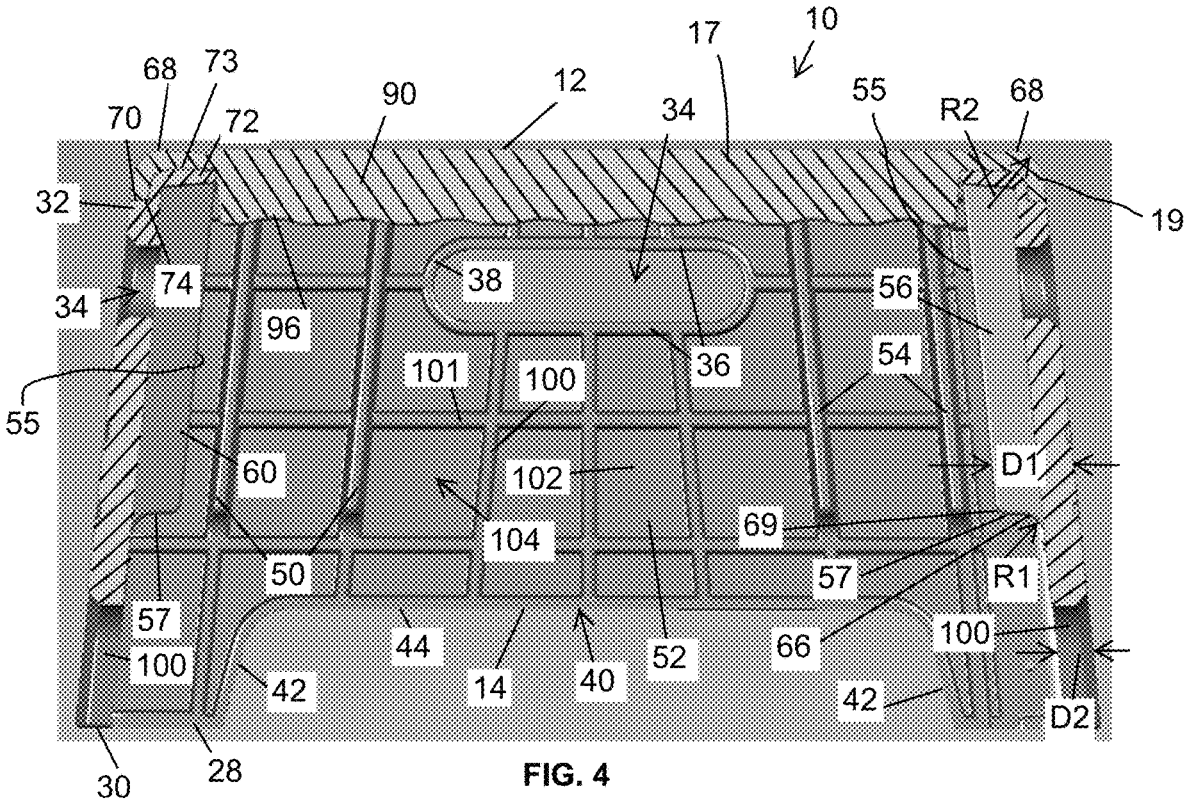
FIG. 4 is a section view of an interior of the plyometric box of FIG. 1.

Each stacking rib 50, 54, 56, 60 may include a bottom surface 57 that extends outwardly from the sidewall 14, 16 toward the interior of the plyometric box 10, seen more clearly in FIG. 4. The bottom surfaces 57 of the stacking ribs 50, 54, 56, 60 may be configured for resting upon or otherwise engaging a portion of another object (e.g., another plyometric box 10) upon which the plyometric box 10 is stacked. In certain embodiments, each stacking rib 50, 54, 56, 60 may extend outwardly from a wall support rib 100 (described in greater detail below) toward the interior of plyometric box 10. In such an embodiment, as illustrated in FIG. 4, the combination of the respective stacking rib 50, 54, 56, 60 and wall support rib 100 has a depth D1, while wall support rib 100 itself has a depth D2. Additionally, each stacking rib 50, 54, 56, 60 may have a vertically-extending inner edge 55 that is angled inwardly and upwardly with respect to the vertical direction, and the inner edges 55 of each stacking rib 50, 54, 56, 60 may be angled at the same angle A as the respective sidewall 14, 16 to which the stacking rib 50, 54, 56, 60 is connected.

Stacking ribs 50, 54, 56, 60 advantageously allow a plyometric box 10 to be stacked on another plyometric box 10 without the two plyometric boxes becoming wedged together when stacked. This allows users to stack, and then easily unstack, two or more plyometric boxes 10 together.

The transition or intersection between the bottom surface 57 of each stacking rib 50, 54, 56, 60 and an interior edge of one of vertical support walls 100 may include an arc or fillet 66 with a radius R1. As illustrated in FIG. 4, in certain embodiments, a top peripheral edge 68 of platform 12 may be rounded over with a radius of R2, which is equal or substantially equal to radius R1. Providing fillet 66 with radius R1 that is the same as the radius R2 of the rounded over peripheral edges 68 of platform 12 helps ensure that multiple plyometric boxes 10 and quickly, easily, and smoothly be stacked together, and then unstacked without plyometric boxes 10 being wedged together. The plyometric boxes 10 can also be stacked in a secure and stable manner due to a combination of factors, including the radii R1, R2 being the same, the relatively large number (e.g., 16 in FIGS. 1-5) of stacking ribs 50, 54, 56, 60, and the positioning of the stacking ribs 50, 54, 56, 60 proximate the corners 26, 28.

The transition or intersection 69 between the bottom surface 57 of each stacking rib 50, 54, 56, 60 and an interior edge of the respective stacking rib may be rounded over, to help ensure that multiple plyometric boxes 10 can be easily be stacked together and subsequently unstacked.

Figure 4A:
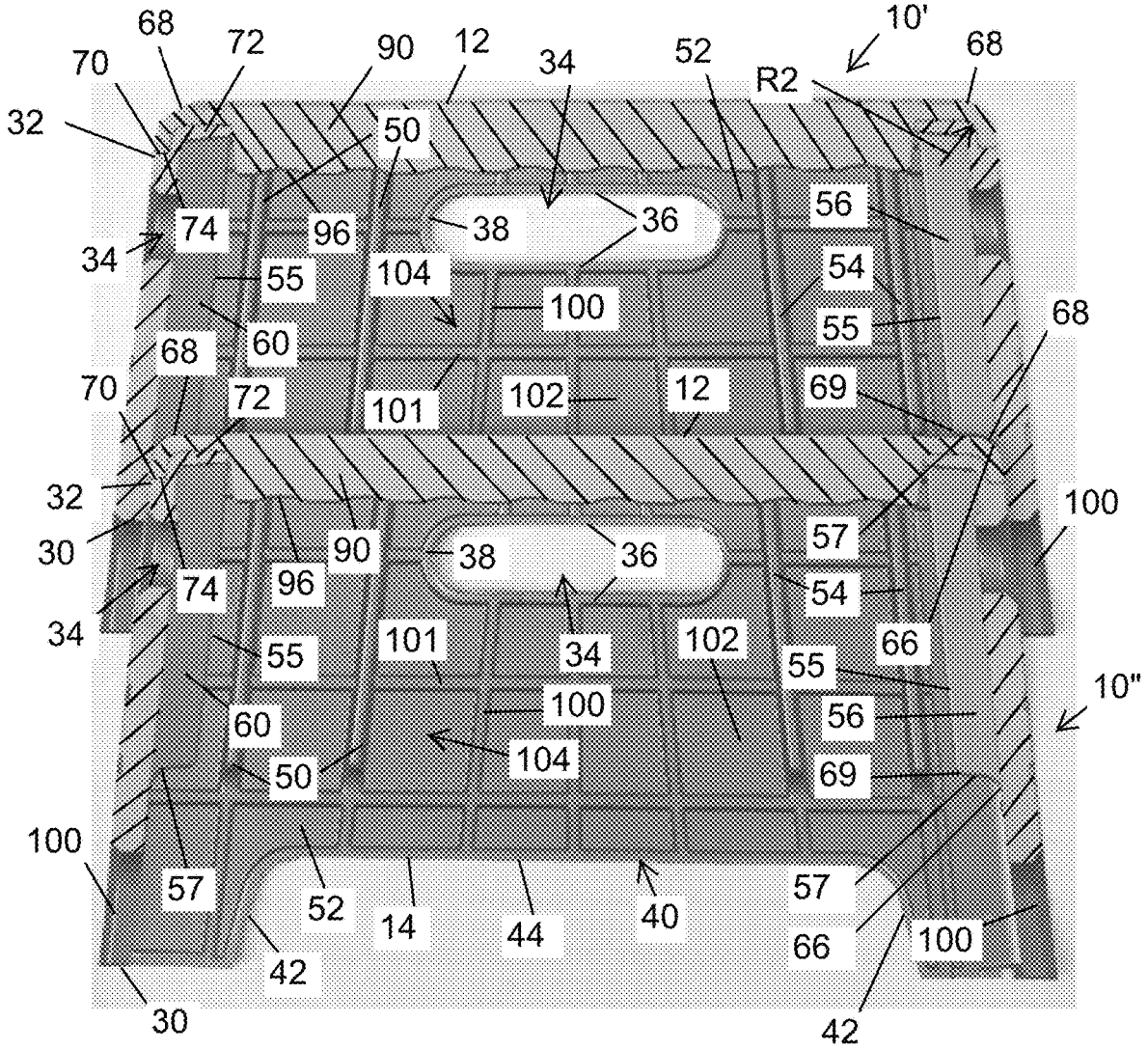
FIG. 4A is a section view of the plyometric box of FIG. 1 stacked on a similar plyometric box.

When a first plyometric box 10' (top box) is stacked on and nested with a second plyometric box 10" (bottom box), as illustrated in FIG. 4A, a portion of the bottom box 10" is received within the interior of the top box 10', including at least the platform 12 and the top peripheral edges 68 thereof, and the boxes 10', 10" engage each other to create a stable stacking arrangement. In the embodiment illustrated in FIG. 4A, the bottom surfaces 57 of the stacking ribs 50, 54, 56, 60 of the first plyometric box 10' (the top box) are seated on the top surface 48 of platform 12 of the second plyometric box 10" (the bottom box). The bottom surfaces 57 of the stacking ribs 50, 54, 56 of the top box 10' rest on the top peripheral edges 68 of the bottom box 10" in this configuration, such that the curved surfaces of the top peripheral edges 68 (i.e., having radius R2) of the bottom box 10" engage fillets 66 (having radius R1) of the stacking ribs 50, 54, 56 of the top box 10'. As such, the bottom surfaces 57 of all of the stacking ribs 50, 54, 56, 60 are located at the same distance below the top surface of the platform 12 and the same distance above the surface on which the plyometric box 10 sits. It is to be appreciated that more than two plyometric boxes 10 can be stacked in such fashion.

In certain embodiments, an upwardly facing shoulder 70 may be formed at top edge 32 of each sidewall 14, 16, and a lip 72 may extend inwardly from top edge 32 and shoulder 70 underneath a portion of platform 12. A bottom surface 73 of the rounded over peripheral edge 68 may be seated on lip 72, with a distal end 74 of the peripheral edge 68 being seated on the shoulder 70, such that platform 12 and sidewalls 14, 16 nest together, helping improve the structural integrity of plyometric box 10. A plurality of fasteners (not visible here), such as bolts or screws, for example, may be received in apertures 76 (see FIG. 1) formed in platform 12 in order to secure platform 12 to sidewalls 14, 16. The fasteners may be used to directly fasten platform 12 to lips 72 of sidewalls 14, 16.

Figure 5:
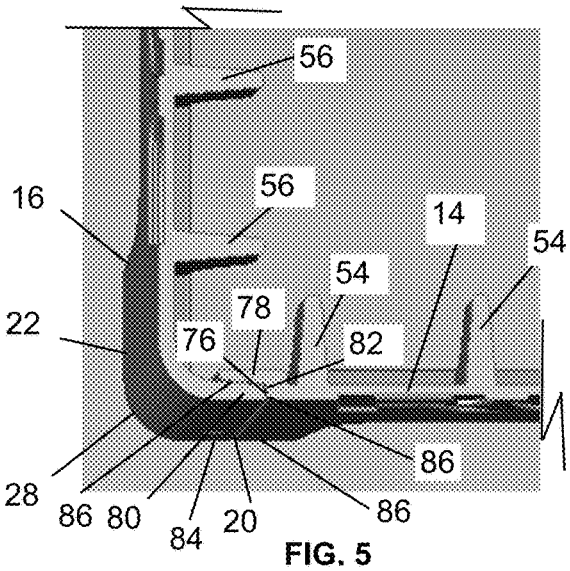
FIG. 5 is a section view, partially broken away, of a corner and sidewalls of the plyometric box of FIG. 1.

As illustrated in FIG. 5, an inwardly extending shoulder 76 may be formed at second side 20 of each first sidewall 14, with a lip 78 extending laterally outwardly from the edge of second side 20. In the configuration shown in FIG. 5, the shoulder 76 extends inwardly from the exterior surface 86 of the first sidewall 14 to the lip 78, such that the lip 78 is recessed from the exterior surface 86. First side 22 of each second sidewall 16 may terminate in a curved arm 80 that defines second corner 28, and nests against shoulder 76 and lip 78, such that the distal end 83 of the curved arm 80 nests against shoulder 76, and the interior side 85 of the curved arm 80 nests against shoulder 76. As illustrated here, the exterior surface 84 of arm 80 and the exterior surface 86 of first sidewall 14 may be substantially flush with one another. A plurality of fasteners (not visible here), such as bolts or screws, for example, may be received in apertures 88, as seen in FIG. 1, formed in arm 80 order to second sidewall 16 to first sidewall 14. The fasteners may be used to directly fasten arm 80 of second sidewall 16 to lip 78 of first sidewall 14.

It is to be appreciated that a similarly formed lip 78 may be positioned at second side 24 of each second sidewall 16, and that a similarly formed arm 80 positioned at first side 18 of each first sidewall 14 at first corner 26 may be directly fastened to a lip 78 on second sidewall 16 in the same manner. In this configuration, the sidewalls 14, 16 and the corners 26, 28 may be formed by four identical pieces 13, each having a lip 76, 78 formed at the second (e.g., left) side 20, 24, and each having a curved arm 80 formed at the first (e.g., right) side 18, 22, and each having a shoulder 70 and a lip 72 at a top edge 32, which pieces 13 are connected together as described herein. Each of the feet 15 may be formed by portions of two adjacent pieces 13 and may have a curved portion formed by the curved arm 80. The construction of the plyometric box 10 may also include a top piece 17 that is connected to the tops of all four sidewall pieces 13, e.g., by additional fasteners (not shown) received in fastener holes 88 that extend through the platform 12 and the tops of the sidewall pieces 13. The top piece 17 in FIGS. 1-5 includes the platform 12, lips 19 curving downward and outward from the platform 12 to define the rounded edges 68, and platform support ribs 90, among other structures.

Figure 3:
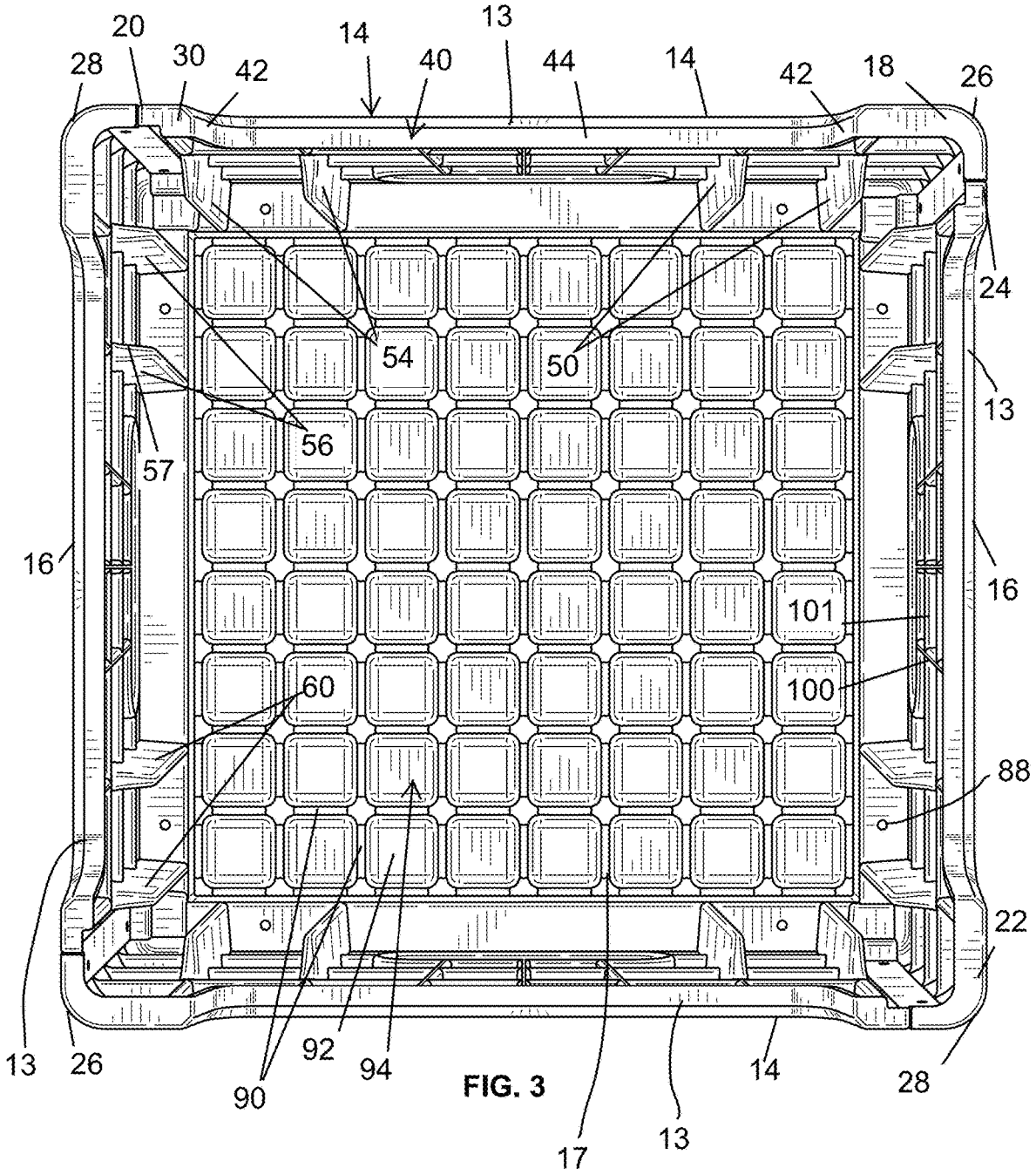
FIG. 3 is a plan view of the bottom of the plyometric box of FIG. 1.

As illustrated in FIGS. 2-3, a plurality of platform support ribs 90 may extend downwardly from a bottom surface 92 of platform 12 toward the interior of plyometric box 10. Platform support ribs 90 may serve to strengthen platform 12, helping provide support for when users jump onto platform 12. As illustrated here, platform support ribs 90 may be formed in a plurality of parallel and perpendicular intersecting rows, forming a grid or array of rectangular recesses 94. It is to be appreciated that a lower surface 96 of each platform support rib 90 may be curved as seen in FIG. 2 to form an arch opening toward the interior of plyometric box 10.

As illustrated in FIG. 2, a plurality of vertical wall support ribs 100 and horizontal wall support ribs 101 may be formed on an interior surface 102 each of first sidewalls 14 and second sidewalls 16, thereby increasing the strength of sidewalls 14, 16, and helping provide support for when users jump onto platform 12. Wall support ribs 100,101 may be formed in a plurality of parallel columns and rows, respectively, thereby defining rectangular recesses 104 between the intersecting columns and rows of wall support ribs 100, 101.

Figure 7:
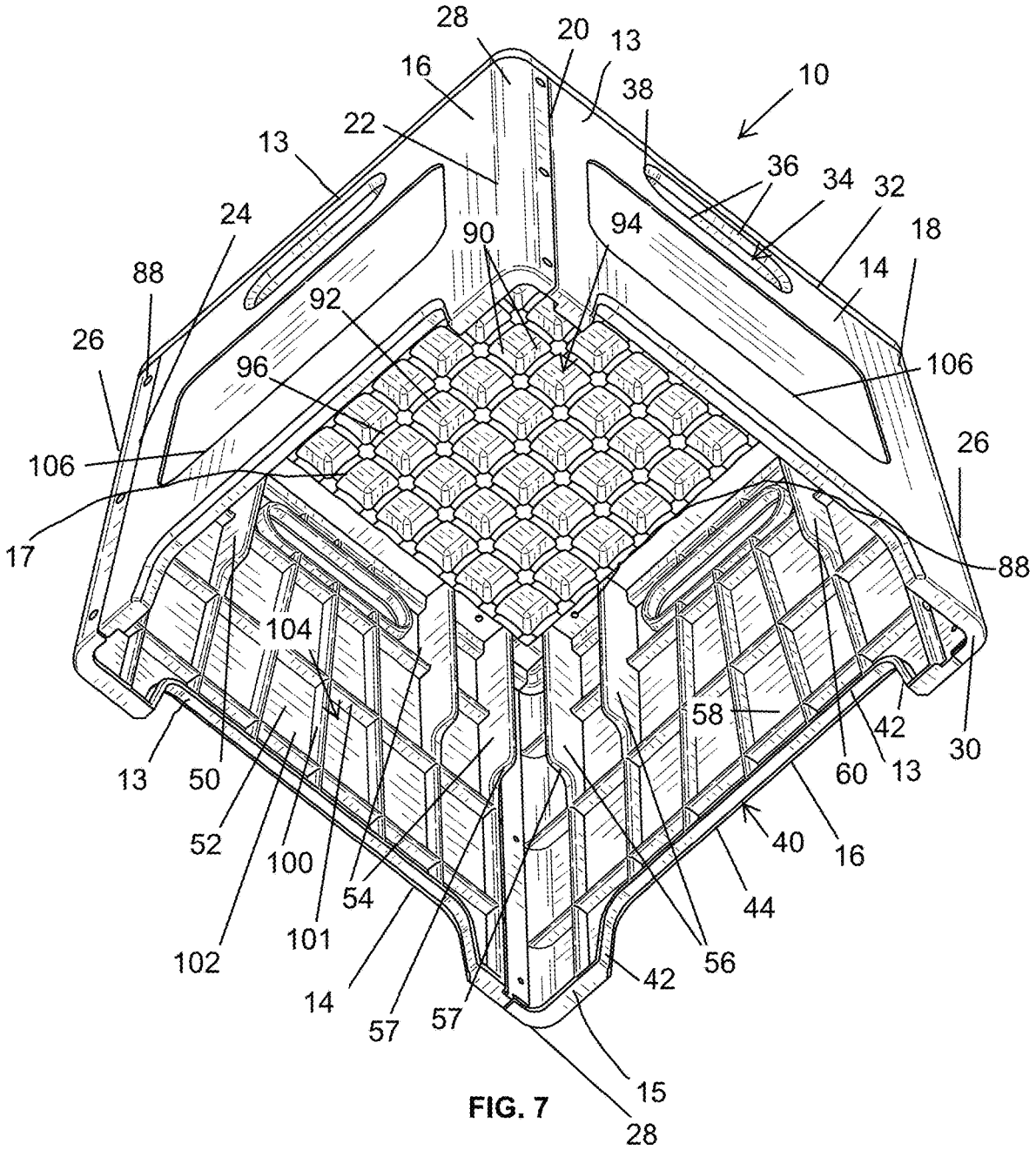
FIG. 7 is a bottom perspective view of the plyometric box of FIG. 6.

Another embodiment of plyometric box 10 is seen in FIGS. 6-7, in which its height H is greater than the embodiment illustrated in FIG. 1. The structure of the plyometric box 10 in FIGS. 6-7 is similar or identical to the structure of the plyometric box 10 in FIGS. 1-5 in many respects, and certain similar or identical components may be referred to herein with the same reference numbers and may not be described again in detail for the sake of brevity. In such an embodiment where height H is greater than the height of 12 inches illustrated in FIG. 1, first sidewalls 14 and second sidewalls 16 may include a wall recess 106 positioned below aperture 34 and above upper surface 44 of wall notch 40. Wall recesses 106 may provide additional structural integrity and strength, as well as an aesthetic benefit for plyometric box 10. Additionally, in certain embodiments, graphic elements or other aesthetic enhancements may be provided within wall recess 106. In the illustrated embodiment, height H of first and second sidewalls 14, 16 may be approximately 18 inches. It is to be appreciated that height H can have any desired value. In one particular embodiment, a series of four plyometric boxes 10 with heights H of approximately 12, 18, 20, and 24 inches may be provided, which will allow a user to have four different plyometric boxes 10 with varied heights H to jump up onto and off of. In this embodiment, all plyometric boxes 10 of the set may have the same width W and length L as shown in FIG. 6, with different heights H. It is understood that the boxes 10 of the set may have different peripheral sizes (width and length) at their bases. Additionally, the series of boxes 10 with different heights H may all be stacked on top of one another as described herein in any arrangement. In one embodiment, all of these multiple plyometric boxes 10 of multiple different heights H may have sidewalls 14, 16 and stacking ribs 50, 54, 56, 60 arranged at the same angles A among all of the boxes 10. Other dimensions, such as the angle B and/or the radii of curvature R1 and R2 may also be the same among all of the multiple plyometric boxes 10. In this configuration, the boxes 10 may be stackable upon each other in a number of different orders or arrangements.

Various embodiments of plyometric box 10 have been described herein, which include various components and features. In other embodiments, plyometric box 10 may be provided with any combination of such components and features. It is also understood that in other embodiments, the various devices, components, and features of the plyometric box 10 described herein may be constructed with similar structural and functional elements having different configurations, including different ornamental appearances.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Terms "top," "bottom," "left," "right," "upper," "lower," and the like, as used herein, are intended for illustrative purposes only and do not limit the embodiments in any way. When used in description of a method or process, the term "providing" (or variations thereof) as used herein means generally making an article available for further actions, and does not imply that the entity "providing" the article manufactured, assembled, or otherwise produced the article. Nothing in this specification should be construed as requiring a specific three dimensional orientation of structures in order to fall within the scope of this invention, unless explicitly specified by the claims. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A plyometric box, comprising:

a platform; and a first pair of opposed sidewalls and a second pair of opposed sidewalls rotationally fixed with respect to one another, each sidewall extending downwardly from the platform and including a first side, an opposed second side, a first stacking rib on an interior surface of the sidewall proximate the first side, and a second stacking rib on an interior surface of the sidewall proximate the second side, wherein each of the first and second stacking ribs extends downwardly from the platform along the respective sidewall and has a vertically-extending inner edge, an entirety of the inner edge being exposed, and wherein each of the first and second stacking ribs has a bottom surface extending outwardly into an interior of the plyometric box, and wherein the bottom surface of each of the first and second stacking ribs is spaced upwardly from a bottom edge of the respective sidewall.

2. The plyometric box of claim 1, wherein each sidewall further includes a plurality of vertical wall support ribs, and each of the first and second stacking ribs extends outwardly from one of the vertical wall support ribs into the interior of the plyometric box.

3. The plyometric box of claim 2, further comprising a plurality of fillets, each fillet positioned at an intersection of the bottom surface of one of the first and second stacking ribs and an interior edge of one of the vertical wall support ribs.

4. The plyometric box of claim 2, wherein an intersection of a top surface of the platform and an exterior surface of each sidewall is rounded over with a first radius, and a fillet positioned at an intersection of the bottom surface of one of the first and second stacking ribs and an interior edge of one of the vertical wall support ribs has a second radius that is substantially the same as the first radius.

5. The plyometric box of claim 1, wherein an intersection of the bottom surface and an interior edge of each of the first and second stacking ribs is rounded over.

6. The plyometric box of claim 1, wherein an intersection of a top surface of the platform and an exterior surface of each sidewall is rounded over.

7. The plyometric box of claim 1, wherein the first side of each sidewall is connected to the second side of an adjacent sidewall to form a corner of the plyometric box.

8. The plyometric box of claim 1, further comprising:

an upwardly facing shoulder at a top edge of each sidewall; and a lip extending inwardly from the top edge of each sidewall beneath the platform, wherein a bottom surface of a rounded over peripheral edge of the platform is seated on the upwardly facing shoulders of the sidewalls.

9. The plyometric box of claim 8, wherein the platform is secured to each of the lips with a plurality of fasteners.

10. The plyometric box of claim 1, wherein each sidewall extends downwardly and outwardly from the platform at an angle of approximately 2-10° with respect to vertical.

11. The plyometric box of claim 1, further comprising a plurality of elongated apertures, each aperture formed proximate an upper edge of one of the sidewalls.

12. The plyometric box of claim 1, further comprising a plurality of recesses formed in a top surface of the platform and arranged in an array.

13. The plyometric box of claim 1, further comprising:

a curved arm formed along the first side of each sidewall and defining a corner of the plyometric box;

a shoulder formed at the second side of each sidewall; and a lip extending laterally outwardly from the second side of each sidewall, wherein an end of the curved arm of each sidewall is nested against one of the shoulders and an exterior surface of the lip of an adjacent sidewall.

14. The plyometric box of claim 13, wherein each curved arm is secured to the lip of the adjacent sidewall with a plurality of fasteners.

15. The plyometric box of claim 1, further comprising a notch formed in each of the sidewalls, the notch including a pair of opposed notch sidewalls extending upwardly from the bottom edge of the sidewall and an upper surface extending between the opposed notch sidewalls.

16. The plyometric box of claim 1, wherein the first stacking rib of each sidewall is part of a first pair of stacking ribs proximate the first side of the sidewall, and the second stacking rib of each sidewall is part of a second pair of stacking ribs proximate the second side of the sidewall.

17. A stack of plyometric boxes including a plyometric box according to claim 1 and a second plyometric box, wherein the plyometric box is stacked on top of the second plyometric box such that a top surface of the second plyometric box engages the bottom surfaces of the first and second stacking ribs of the plyometric box.

18. The stack of plyometric boxes of claim 17, wherein the plyometric box and the second plyometric box have different heights.

19. The stack of plyometric boxes of claim 17, wherein the plyometric box and the second plyometric box are configured for stacking such that the second plyometric box is stacked upon the plyometric box.

20. A plyometric box, comprising:

a platform; and a first pair of opposed sidewalls and a second pair of opposed sidewalls rotationally fixed with respect to one another, each sidewall extending downwardly from the platform and including a first side and an opposed second side, wherein each sidewall comprises a curved arm formed along the first side of the sidewall and defining a corner of the plyometric box, a shoulder formed at the second side of the sidewall, and a lip extending laterally outwardly from the second side of the sidewall, such that the lip is recessed from an exterior surface of the sidewall, and the shoulder extends from the exterior surface to the lip, and wherein an end of the curved arm of each sidewall is nested against one of the shoulders and an exterior surface of the lip of an adjacent sidewall.

21. The plyometric box of claim 20, wherein each sidewall includes a plurality of stacking ribs each having a bottom surface extending outwardly into an interior of the plyometric box, and wherein the bottom surface of each of the stacking ribs is spaced upwardly from a bottom edge of one of the sidewalls.

22. The plyometric box of claim 20, further comprising:

an upwardly facing shoulder at a top edge of each sidewall; and a lip extending inwardly from the top edge of each sidewall beneath the platform, wherein a bottom surface of a rounded over peripheral edge of the platform is seated on the upwardly facing shoulders of the sidewalls.

23. A plyometric box, comprising:

a platform;

a first pair of opposed sidewalls and a second pair of opposed sidewalls, each sidewall extending downwardly from the platform, including a first side, an opposed second side, a bottom edge, a top edge, an aperture extending through the sidewall proximate the top edge, a first stacking rib on an interior surface of the sidewall between the aperture and the first side, and a second stacking rib on the interior surface of the sidewall between the aperture and the second side; and a plurality of vertical wall support ribs, each vertical wall support rib extending along one of the sidewalls, wherein each of the first and second stacking ribs has a bottom surface extending outwardly into an interior of the plyometric box, and wherein the bottom surface of each of the first and second stacking ribs is spaced upwardly from the bottom edge of one of the sidewalls, wherein each of the first and second stacking ribs extends outwardly from one of the vertical wall support ribs into the interior of the plyometric box, wherein an intersection of a top surface of the platform and an exterior surface of each sidewall is rounded over with a first radius, and wherein an intersection of the bottom surface of each of the first and second stacking ribs and an interior edge of one of the wall support ribs includes a fillet having a second radius that is substantially the same as the first radius.

* * * * *